US010866536B2

(12) United States Patent
Kuwata et al.

(10) Patent No.: US 10,866,536 B2
(45) Date of Patent: Dec. 15, 2020

(54) DEVELOPING DEVICE WITH SEALING UNIT, PROCESS CARTRIDGE USING DEVELOPING DEVICE, AND IMAGE FORMING APPARATUS

(71) Applicant: FUJI XEROX CO., LTD., Tokyo (JP)

(72) Inventors: Yosuke Kuwata, Kanagawa (JP); Takashi Akaike, Kanagawa (JP); Shota Makita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/294,950

(22) Filed: Mar. 7, 2019

(65) Prior Publication Data

US 2020/0096904 A1 Mar. 26, 2020

(30) Foreign Application Priority Data

Sep. 26, 2018 (JP) ..... 2018-180660

(51) Int. Cl.
*G03G 15/08* (2006.01)
*G03G 21/18* (2006.01)

(52) U.S. Cl.
CPC ..... *G03G 15/0868* (2013.01); *G03G 15/0881* (2013.01); *G03G 21/18* (2013.01)

(58) Field of Classification Search
USPC ..... 399/262
See application file for complete search history.

(56) References Cited

U.S. PATENT DOCUMENTS 6,178,302 B1 * 1/2001 Nagashima ..... G03G 15/0896 399/106
2009/0169240 A1 * 7/2009 Kawahito ..... G03G 15/0882 399/106

FOREIGN PATENT DOCUMENTS

JP 59093471 A * 5/1984 ..... G03G 15/0882
JP 63094266 A * 4/1988 ..... G03G 15/0875
(Continued)

OTHER PUBLICATIONS

Computer translation of JP59-093471A to Oka (Year: 1984).*

*Primary Examiner* — Quana Grainger
(74) *Attorney, Agent, or Firm* — JCIPRNET

(57) ABSTRACT

A developing device includes a developer storing unit that stores a developer before use of the developing device, a developer containing unit that contains, when the developing device is used, the developer stored in the developer storing unit such that the developer is capable of being stirred by the developer containing unit, a developer holding unit that is provided in a portion of the developer containing unit and that holds the developer contained in the developer containing unit and moves the developer in a rotation direction, a sealing unit including a sealing tape portion that seals a slit-shaped opening formed in the developer storing unit along a longitudinal direction of the developer storing unit while the sealing tape portion is capable of being pulled out and that seals the slit-shaped opening of the developer storing unit by being removably fixed onto an edge of the opening and an extended tape portion that is folded at an end of the sealing tape portion in a longitudinal direction of the sealing tape portion and that extends along the sealing tape portion in such a manner as to project outward beyond the sealing tape portion, a scraping unit that is disposed at an end portion of the developer storing unit in the longitudinal direction and that causes the extended tape portion of the sealing unit to move while making frictional contact with the scraping unit so as to scrape off developer powder deposited on the extended tape portion and on the sealing tape portion, which follows movement of the extended tape portion, and a holding unit that is disposed outside the scraping unit in the longitudinal direction of the developer storing unit with a space formed between the holding unit and the scraping unit and that holds the extended tape portion and the sealing tape
(Continued)

portion such that the extended tape portion and the sealing tape portion are capable of moving.

13 Claims, 12 Drawing Sheets

(56) References Cited

FOREIGN PATENT DOCUMENTS

| | | | | | |
|---|---|---|---|---|---|
| JP | 63279285 | A | * | 11/1988 | ..... G03G 15/0882 |
| JP | 2002221856 | | | 8/2002 | |
| JP | 2012103287 | | | 5/2012 | |

* cited by examiner

DEVELOPING DEVICE WITH SEALING UNIT, PROCESS CARTRIDGE USING DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2018-180660 filed Sep. 26, 2018.

BACKGROUND

(i) Technical Field

The present disclosure relates to a developing device, a process cartridge using the developing device, and an image forming apparatus.

(ii) Related Art

In the related art, known examples of this type of developing device include those described in Japanese Unexamined Patent Application Publication No. 2012-103287 (Background Art, FIG. 12), which will be referred to as Patent Document 1, and Japanese Unexamined Patent Application Publication No. 2002-221856 (Description of the Embodiments, FIG. 18), which will be referred to as Patent Document 2.

Patent Document 1 discloses a process cartridge in which an opening formed in a toner containing unit of a developing device is sealed by a toner seal and in which the toner seal is folded in two at an end portion of the opening in the longitudinal direction of the opening in such a manner that an end of the folded portion projects outward from a slit formed in a side surface of the toner containing unit. The end portion of the toner seal projecting from the slit is pulled at the beginning of use of the process cartridge, so that the toner seal is removed through the opening of the toner containing unit, and a toner is supplied into the developing device through the opening.

Patent Document 2 discloses a process cartridge in which an extended portion of the toner seal member is to be pulled out from a hole of a toner-development frame body and in which an end member that is disposed at an end of the toner-development frame body in the longitudinal direction of the toner-development frame body is provided with a restricting portion that functions as a guide for the toner seal member in a width direction of the toner seal member when the toner seal member is pulled out, so that an opening, through which a toner is supplied, is stably formed into the toner-development frame body when the toner seal member is pulled out.

However, in the technique described in Patent Document 1, when the end portion of the toner seal projecting from the side surface of the toner containing unit is pulled, there is a concern that, if the toner seal is pulled while being inclined, the toner seal may be torn or may have wrinkles generated in a portion thereof, which in turn results in leakage of a developer.

In addition, the toner seal projects from the side surface of the toner containing unit, and a projecting portion of the toner seal is in a free state. Thus, for example, when the toner containing unit, which is a subassembly, is incorporated into the development device, it is necessary for an operator to hold the projecting portion of the toner seal while incorporating the toner containing unit into the development device, and this has placed a workload on the operator. In addition, there is a concern that, if priority is given to the operational efficiency, this requires an unnecessary extra labor of temporarily holding the projecting portion of the toner seal by using a temporary adhesion tape or the like.

Regarding this, in Patent Document 2, since the end member that is disposed at the end of the toner-development frame body (corresponding to the toner containing unit in Patent Document 1) in the longitudinal direction is provided with the restricting portion that functions as a guide for the toner seal member (corresponding to the toner seal in Patent Document 1) in the width direction when the toner seal member is pulled out, the degree of inclination of the toner seal member in a direction in which the toner seal member is pulled out is reduced compared with the case of employing the technique described in Patent Document 1. However, the concern that, if the toner seal member is pulled while being inclined in the width direction, the toner seal member may be torn or may have wrinkles generated in a portion thereof, which in turn results in leakage of a developer, remains.

In addition, when the toner-development frame body, which is a subassembly, is incorporated into the development device, the extended portion of the toner seal member that projects from a side of the toner-development frame body is in a free state, and thus, similar to Patent Document 1, it is still difficult to improve a situation in which a workload for handling the extended portion of the toner seal member in the operation of incorporating the toner-development frame body has been placed on an operator.

SUMMARY

Aspects of non-limiting embodiments of the present disclosure relate to improving the handleability of an extended portion of a sealing unit that is used for pulling out the sealing unit in an aspect in which a developer stored in a developer storing unit is sealed by the sealing unit and in which the sealed state of the developer maintained by the sealing unit is released when the developer is used.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including a developer storing unit that stores a developer before use of the developing device, a developer containing unit that contains, when the developing device is used, the developer stored in the developer storing unit such that the developer is capable of being stirred by the developer containing unit, a developer holding unit that is provided in a portion of the developer containing unit and that holds the developer contained in the developer containing unit and moves the developer in a rotation direction, a sealing unit including a sealing tape portion that seals a slit-shaped opening formed in the developer storing unit along a longitudinal direction of the developer storing unit while the sealing tape portion is capable of being pulled out and that seals the slit-shaped opening of the developer storing unit by being removably fixed onto an edge of the opening and an extended tape portion that is folded at an end of the sealing tape portion in a longitudinal direction of the sealing tape portion and that extends along the sealing tape portion in such a manner as to project outward beyond the sealing tape portion, a scraping unit that is disposed at an end portion of the developer storing unit in the longitudinal direction and that causes the extended tape portion of the sealing unit to move while making frictional contact with the scraping unit so as to scrape off developer powder deposited on the extended tape portion and on the sealing tape portion, which follows movement of the extended tape portion, and a holding unit that is disposed outside the scraping unit in the longitudinal direction of the developer storing unit with a space formed between the holding unit and the scraping unit and that holds the extended tape portion and the sealing tape portion such that the extended tape portion and the sealing tape portion are capable of moving.

BRIEF DESCRIPTION OF THE DRAWINGS

An exemplary embodiment of the present disclosure will be described in detail based on the following figures, wherein.

DETAILED DESCRIPTION

Overview of Exemplary Embodiment

Figure 1A:
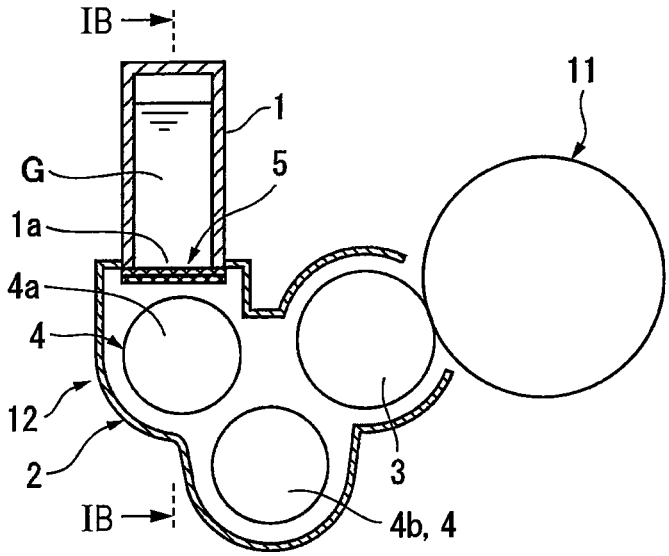
FIG. 1A is a diagram illustrating an overview of an exemplary embodiment of an image forming apparatus that includes a developing device to which the present disclosure is applied.

FIG. 1A is a diagram illustrating an overview of an exemplary embodiment of an image forming apparatus that includes a developing device to which the present disclosure is applied.

In FIG. 1A, the image forming apparatus includes an image holding unit 11 on which a developable latent image is held and a developing device 12 that is disposed so as to face the image holding unit 11 and that develops a latent image on the image holding unit 11.

Here, the image holding unit 11 and the developing device 12 may be integrated with each other so as to form a process cartridge that is detachably mounted onto a housing of the image forming apparatus, which is not illustrated. Alternatively, instead of being integrated with each other so as to form a process cartridge, the image holding unit 11 and the developing device 12 may be incorporated into the image forming apparatus as functional components that are independent of each other. Note that, as the process cartridge may include other functional components (e.g., a charging unit that charges the image holding unit 11 and a cleaning unit that cleans the image holding unit 11 by removing residues deposited on the image holding unit 11) as long as the process cartridge includes the image holding unit 11 and the developing device 12.

Figure 1B:
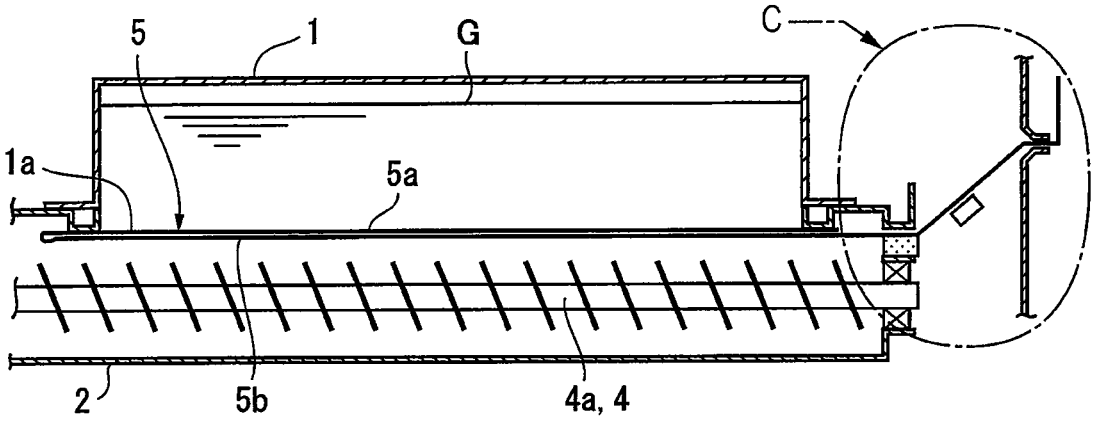
FIG. 1B is a sectional view taken along line IB-IB of FIG. 1A.
Figure 1C:
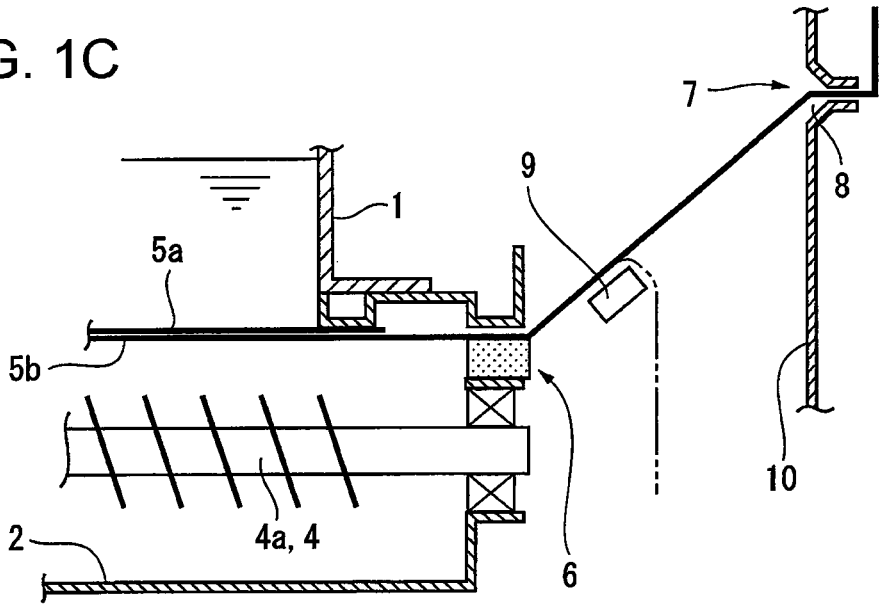
FIG. 1C is a diagram illustrating the details of a portion C in FIG. 1B.

In the present exemplary embodiment, as illustrated in FIGS. 1A to 1C, the developing device 12 includes the following components: a developer storing unit 1 that stores a developer G before use of the developing device 12, a developer containing unit 2 that contains, when the developing device 12 is used, the developer G, which has been stored in the developer storing unit 1, such that the developer G is capable of being stirred thereby, a developer holding unit 3 that is provided in a portion of the developer containing unit 2 and that holds the developer G contained in the developer containing unit 2 and moves the developer G in a rotation direction, a sealing unit 5 including a sealing tape portion 5*a* that seals a slit-shaped opening 1*a* formed in the developer storing unit 1 along the longitudinal direction of the developer storing unit 1 while the sealing tape portion 5*a* is capable of being pulled out and that seals the slit-shaped opening 1*a* of the developer storing unit 1 by being removably fixed onto an edge of the opening 1*a*, and an extended tape portion 5*b* that is folded at an end of the sealing tape portion 5*a* in the longitudinal direction and that extends along the sealing tape portion 5*a* in such a manner as to project outward beyond the sealing tape portion 5*a*, a scraping unit 6 that is disposed at an end portion of the developer storing unit 1 in the longitudinal direction and that causes the extended tape portion 5*b* of the sealing unit 5 to move while making frictional contact with the scraping unit 6 so as to scrape off developer powder deposited on the extended tape portion 5*b* and on the sealing tape portion 5*a*, which follows movement of the extended tape portion 5*b*, and a holding unit 7 that is disposed outside the scraping unit 6 in the longitudinal direction of the developer storing unit 1 with a space formed between the holding unit 7 and the scraping unit 6 and that holds the extended tape portion 5*b* and the sealing tape portion 5*a* such that the extended tape portion 5*b* and the sealing tape portion 5*a* are capable of moving. Note that, in FIGS. 1A to 1C, reference sign 4 denotes a stirring transport unit that includes, for example, a pair of stirring transport members 4*a* and 4*b* and that triboelectrically charges and transports the developer G in the developer containing unit 2 while stirring and mixing the developer G.

In such technical measure, the developer storing unit 1 is not particularly limited as long as the developer storing unit 1 stores the developer G before use of the developing device 12, and examples of the developer storing unit 1 include a storing unit that stores an initial developer (a so-called starter developer) that is supplied to the developer containing unit 2 at the beginning of use of the developing device 12 and a storing unit that stores a replenishing developer to be used when the developing device 12 is used.

The sealing unit 5 corresponds to a seal unit that seals the opening 1*a* of the developer storing unit 1. In a representative aspect, the sealing unit 5 includes the sealing tape portion 5*a* and the extended tape portion 5*b*, and the extended tape portion 5*b* is longer than the sealing tape portion 5*a*.

The scraping unit 6 may be suitably selected as long as the scraping unit 6 is disposed at the end portion of the developer storing unit 1 in the longitudinal direction and causes the extended tape portion 5*b* of the sealing unit 5 and the sealing tape portion 5*a* of the sealing unit 5, which follows movement of the extended tape portion 5*b*, to move while making frictional contact with the scraping unit 6 so as to scrape off developer powder deposited on these tape portions 5*a* and 5*b*. For example, a draw-out port through which the extended tape portion 5*b* of the sealing unit 5 and the sealing tape portion 5*a* of the sealing unit 5, which follows movement of the extended tape portion 5*b*, are drawn out is formed at an end portion of the developer storing unit 1 in the longitudinal direction, and it is necessary to prevent developer powder from leaking from the draw-out port. In an exemplary aspect, a sealing member is disposed at a position adjacent to the draw-out port, and the sealing member scrapes off the developer powder deposited on the tape portions 5*a* and 5*b* by coming into contact with at least a surface of each of the tape portions 5*a* and 5*b* at which the developer containing unit 2 is exposed. An example of the sealing member is an elastic member whose surface that comes into contact with the powder has a frictional resistance that enables the elastic member to scrape off the powder. Note that the sealing member may be provided independently of the developer containing unit 2 or may be provided at a suitable position so as to be formed integrally with the developer containing unit 2.

In addition, in the present exemplary embodiment, the holding unit 7 may at least be disposed outside the scraping unit 6 in the longitudinal direction with a space formed therebetween, and the holding unit 7 may include either or both of a functional element that holds the sealing unit 5 when an operation of pulling out the sealing unit 5 is performed, the pulling out operation being performed when the developing device 12 is used, and a functional element that temporarily holds the extended tape portion 5*b* of the sealing unit 5 in such a manner that the extended tape portion 5*b* is not displaced during the assembly of the developing device 12.

A representative aspect or an exemplary aspect of the developing device according to the present exemplary embodiment will now be described.

First, in the representative aspect, the holding unit 7 has a pull-out port 8 that is formed in a side member 10 disposed outside the developer storing unit 1 in the longitudinal direction and that holds the extended tape portion 5*b* of the sealing unit 5 such that the extended tape portion 5*b* is capable of being pulled out. The present exemplary embodiment works when an operation of pulling out the sealing unit 5 is performed at the beginning of use of the developing device 12, and the present exemplary embodiment is intended to suppress leakage of the developer G due to tearing (breakage phenomenon) of the tape portions 5*a* and 5*b* of the sealing unit 5 or wrinkles generated in the tape portions 5*a* and 5*b* of the sealing unit 5.

In another representative aspect, the holding unit 7 includes a temporary holding portion 9 that is disposed at an end portion of the developer storing unit 1 in the longitudinal direction and that is capable of holding the extended tape portion 5*b* of the sealing unit 5 such that the extended tape portion 5*b* is in a temporarily-held position in which the extended tape portion 5*b* is inclined upward from the position of the scraping unit 6. In the present exemplary embodiment, it is not necessary to perform an operation of holding the sealing unit 5 when the developer storing unit 1 is assembled. In addition, when a subassembly (a component) formed of only the developer storing unit 1 is handled, the sealing unit 5 may be temporarily held without using, for example, a temporary adhesion tape, so that component management is easily performed.

Furthermore, in another representative aspect, the holding unit 7 includes the pull-out port 8 that is formed in the side member 10, which is disposed outside the developer storing unit 1 in the longitudinal direction, and that holds the extended tape portion 5*b* of the sealing unit 5 such that the extended tape portion 5*b* is capable of being pulled out and the temporary holding portion 9 that is disposed at the end portion of the developer storing unit 1 in the longitudinal direction in such a manner as to be located between the pull-out port 8 and the scraping unit 6 and that is capable of holding the extended tape portion 5*b* of the sealing unit 5 in the temporarily-held position, in which the extended tape portion 5*b* is inclined upward from the position of the scraping unit 6. In the present exemplary embodiment, the pull-out port 8 and the temporary holding portion 9 form the holding unit 7.

Next, exemplary aspects of the holding unit 7 are as follows.

In a first aspect, the pull-out port 8 serving as the holding unit 7 is positioned above the scraping unit 6. In this case, tension is easily applied to the sealing unit 5, and wrinkles are less likely to be generated in the sealing unit 5. Thus, this case is intended to more effectively suppress leakage of the developer G due to tearing of the sealing unit 5 or wrinkles of the sealing unit 5.

In a second aspect, the temporary holding portion 9 serving as the holding unit 7 includes a pair of surrounding arms that surround and hold the side edges of the extended tape portion 5*b* of the sealing unit 5 in the width direction of the sealing unit 5. In this case, since the temporary holding portion 9 is formed of the pair of surrounding arms, the extended tape portion 5*b* of the sealing unit 5 is easily temporarily held by using a gap between the arms.

In a third aspect in which the temporary holding portion 9 of the holding unit 7 includes the surrounding arms, each of the surrounding arms has an inclined portion that is located on the side on which the scraping unit 6 is disposed and that is widened toward the scraping unit 6 in the width direction of the sealing unit 5. In this case, since the pair of surrounding arms of the temporary holding portion 9 include the inclined portions, the extended tape portion 5*b* of the sealing unit 5 may be further easily set by guiding operation of the inclined portions.

In a fourth aspect in which the pull-out port 8 and the temporary holding portion 9 form the holding unit 7, the pull-out port 8 is located above the scraping unit 6, and the temporary holding portion 9 has a holding surface that is inclined upward and on which the sealing unit 5 is to be temporarily held. In this case, the position of the pull-out port 8, which is included in the holding unit 7, and the configuration the temporary holding portion 9, which is included in the holding unit 7, are devised in such a manner that a portion of the sealing unit 5 reaching the pull-out port 8 is in a position in which the portion of the sealing unit 5 is parallel to the holding surface of the temporary holding portion 9.

In a fifth aspect in which the pull-out port 8 and the temporary holding portion 9 form the holding unit 7, a movement path of the sealing unit 5 that is located between the scraping unit 6 and the pull-out port 8 is formed at a position where the sealing unit 5 does not come into contact with the temporary holding portion 9. In this case, when the sealing unit 5 is pulled out, the sealing unit 5 does not come into contact with the temporary holding portion 9.

The present disclosure will be described in further detail below on the basis of the exemplary embodiment illustrated in the accompanying drawings.

Exemplary Embodiment

—Overall Configuration of Image Forming Apparatus—

Figure 2:
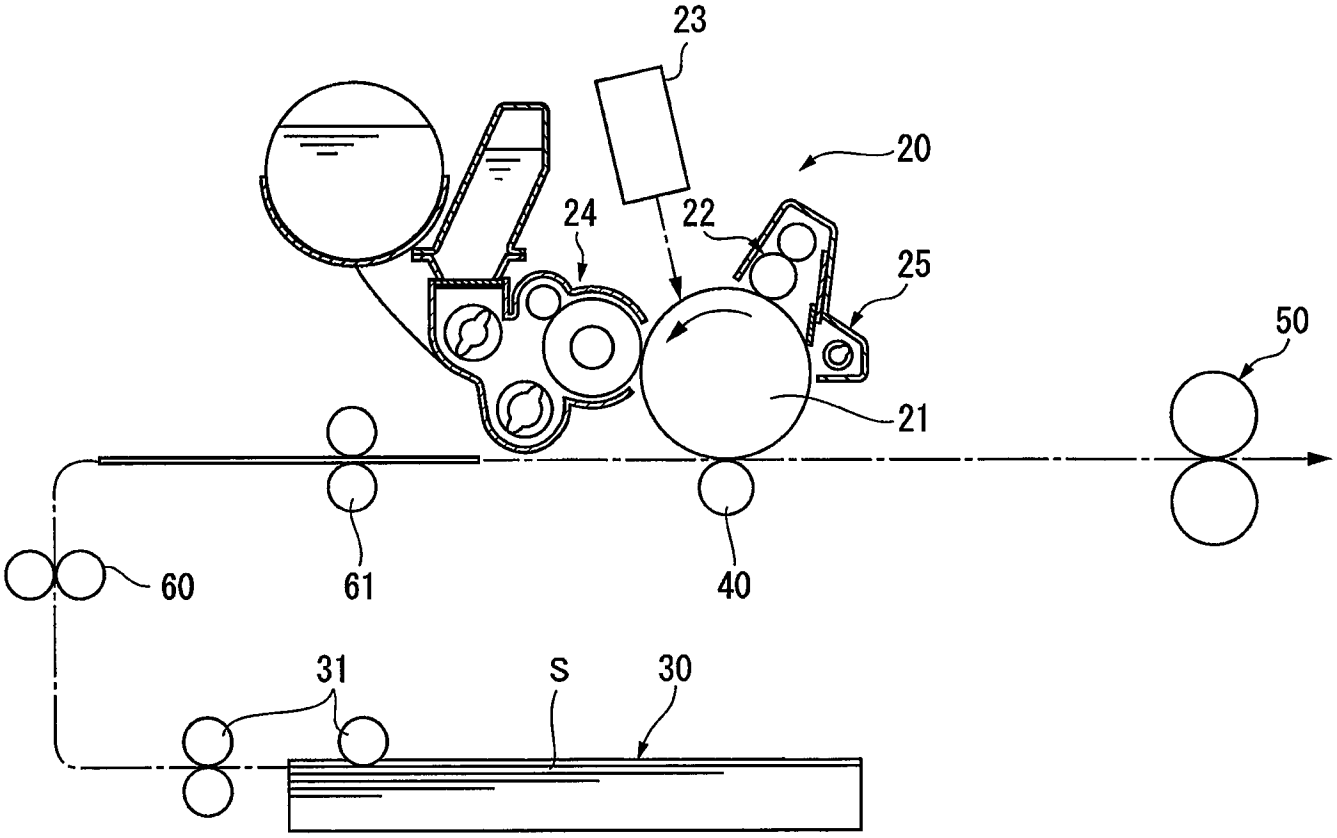
FIG. 2 is a diagram illustrating the overall configuration of the image forming apparatus according to the exemplary embodiment.

FIG. 2 illustrates the overall configuration of the image forming apparatus according to the exemplary embodiment.

In FIG. 2, the image forming apparatus includes an image forming unit 20 that employs an electrophotographic system, a sheet-supply device 30 that supplies a sheet S, which serves as a recording medium, toward the image forming 20, a transfer device 40 that transfers a toner image formed by the image forming unit 20 onto the sheet S supplied by a feeder unit 31 of the sheet-supply device 30, and a fixing device 50 that fixes in place the toner image, which has been transferred to the sheet S. Note that an appropriate number of transport rollers 60 that transport the sheet S are disposed on a transport path of the sheet S, and a position adjustment roller 61 that adjusts the position of the sheet S and then transports the sheet S is provided at a position in front of a transfer region of the transfer device 40.

<Image Forming Unit>

Figure 3:
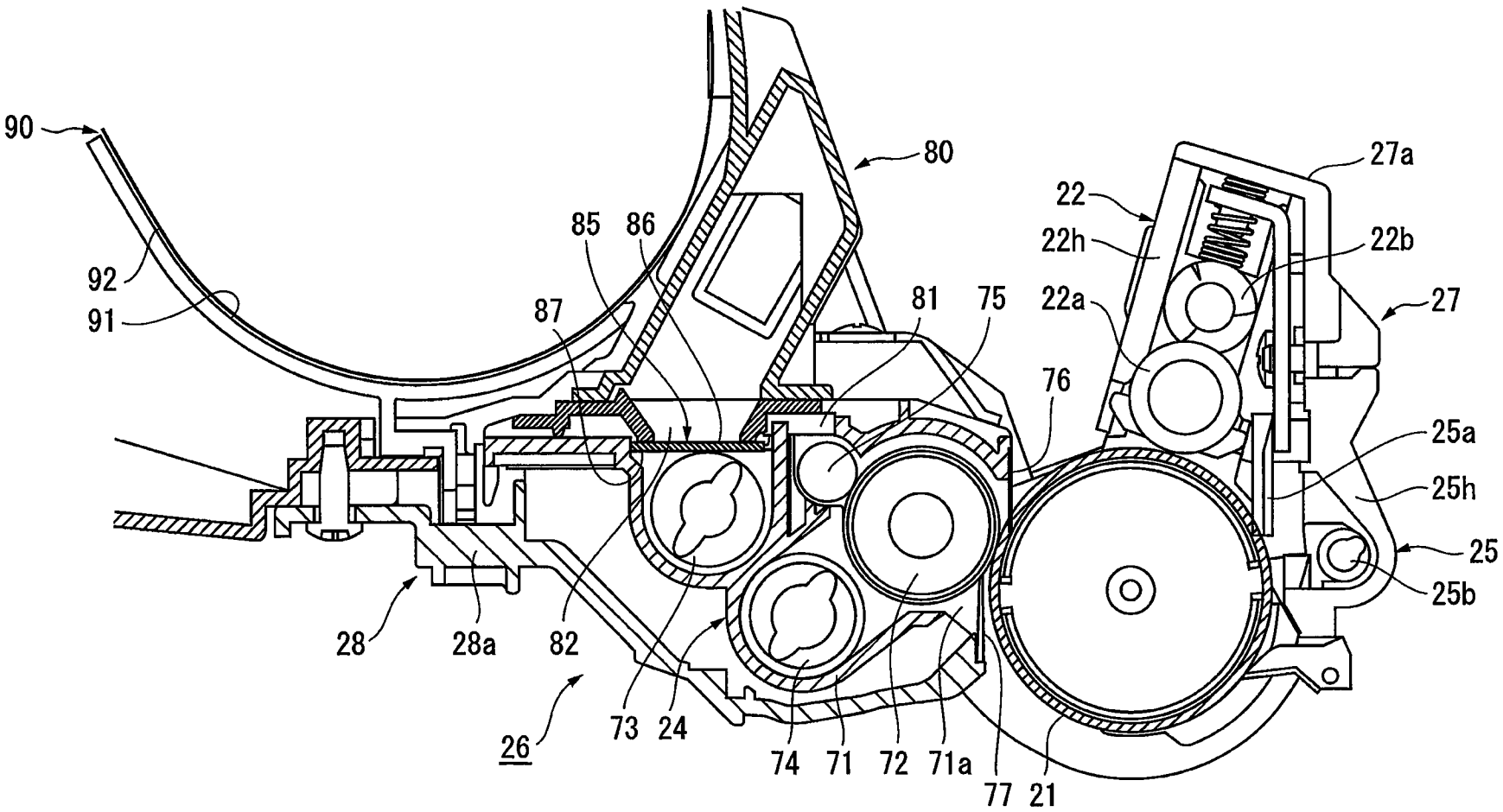
FIG. 3 is a diagram illustrating the details of a process cartridge that is used in the image forming apparatus illustrated in FIG. 2.

In the present exemplary embodiment, as illustrated in FIG. 2 and FIG. 3, the image forming unit 20 includes, for example, a drum-shaped photoconductor 21 serving as an image holding unit that rotates in a predetermined direction. The image forming unit 20 further includes a charging device 22 that charges the photoconductor 21, a latent-image writing device 23 such as a light emitting diode (LED) array or a laser writing device that writes a latent image onto the charged photoconductor 21, a developing device 24 that develops the latent image written on the photoconductor 21 with a developer including a toner, and a cleaning device 25 that that is provided at a position downstream from a transfer region of the photoconductor 21 in the rotation direction and that cleans the photoconductor 21 by removing residues, such as residual toner, deposited on the photoconductor 21, and these devices are arranged around the drum-shaped photoconductor 21.

Here, the elements of the image forming unit 20 may be suitably selected. In the present exemplary embodiment, for example, the charging device 22 includes a charging roller 22*a* that is disposed in a charging housing 22*h* in such a manner as to be in contact with the photoconductor 21 and a cleaning roller 22*b* that cleans the charging roller 22*a*, and the cleaning device 25 includes a cleaning blade 25*a* that is provided at an opening edge of a cleaning housing 25*h* and that scrapes off residues deposited on a surface of the photoconductor 21 and a smoothing screw 25*b* that is disposed in the cleaning housing 25*h* and that smooths the residues scraped off by the cleaning blade 25*a*.

In particular, in the present exemplary embodiment, as illustrated in FIG. 2 to FIG. 5, the image forming unit 20 is configured as a process cartridge 26 including the elements excluding the latent-image writing device 23 that are integrated with one another. The process cartridge 26 includes a photoconductor unit 27 in which the photoconductor 21, the charging device 22, and the cleaning device 25 are built in a first cartridge housing 27*a* and a developing unit 28 in which the developing device 24 that is capable of being supplied with the starter developer and the replenishing developer is built in a second cartridge housing 28*a*, and the photoconductor unit 27 and the developing unit 28 are connected to each other so as to have a predetermined positional relationship.

Figure 4:
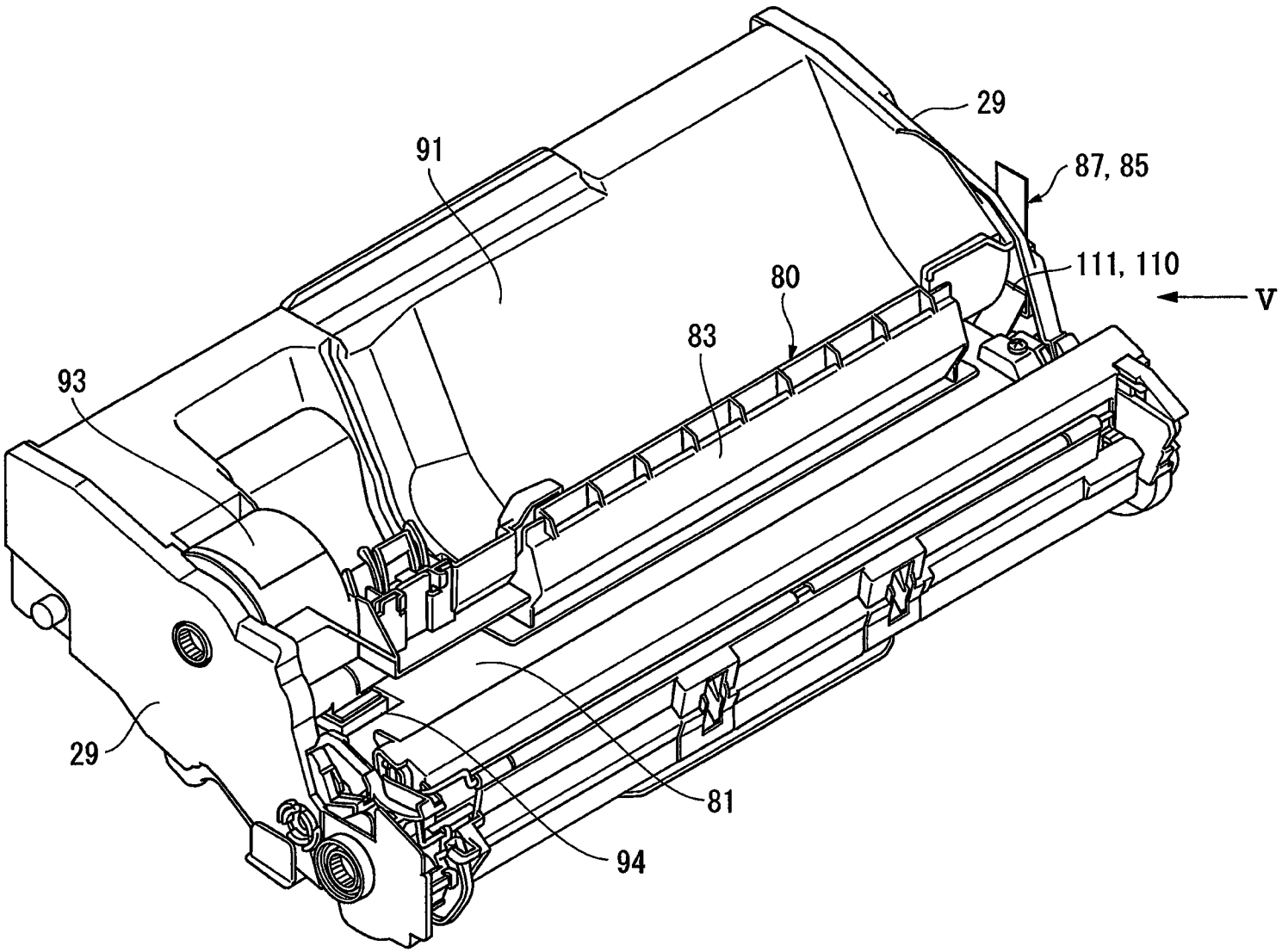
FIG. 4 is a perspective view of the process cartridge illustrated in FIG. 3.
Figure 5:
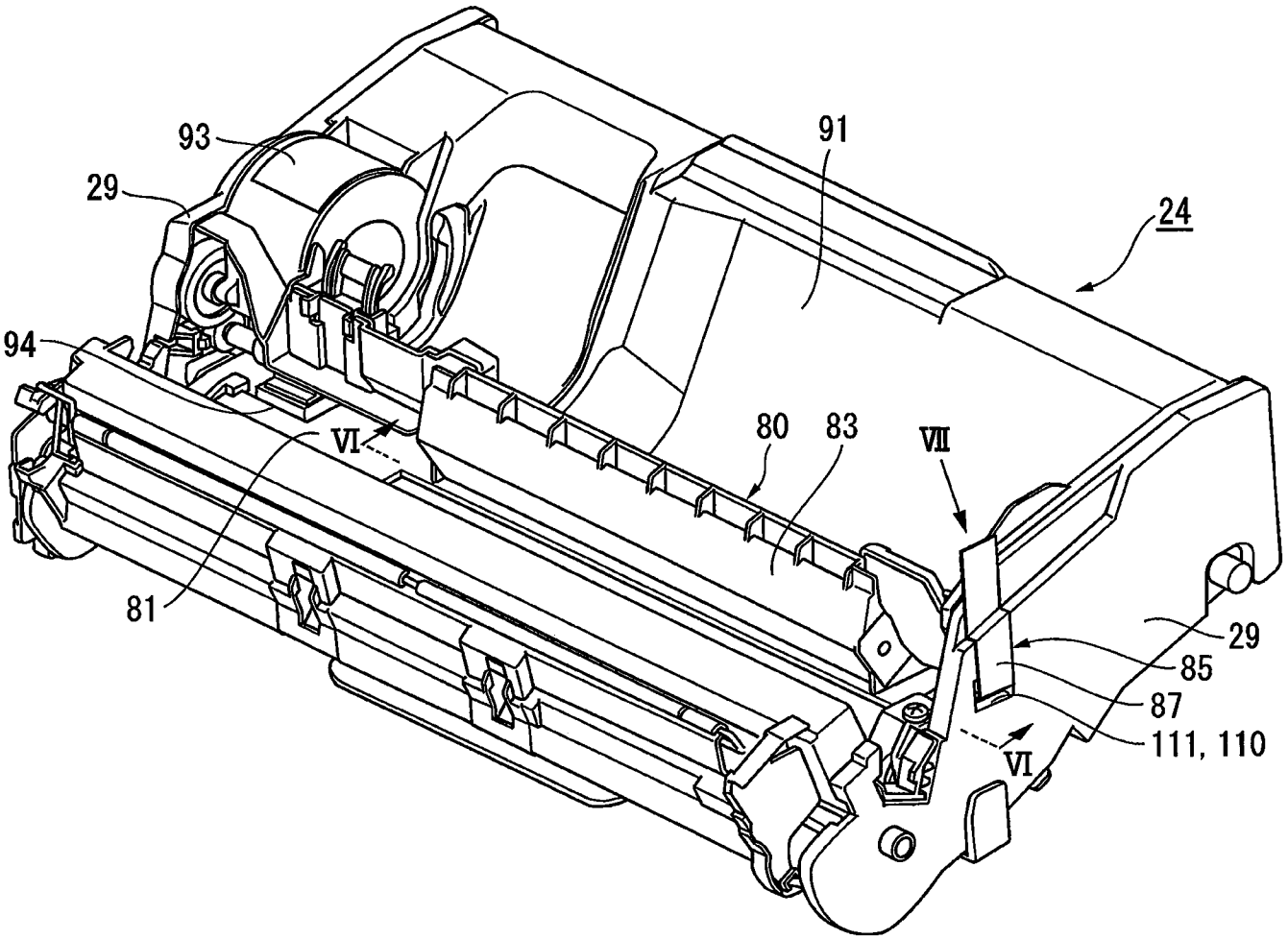
FIG. 5 is a perspective view when viewed in the direction of arrow V in FIG. 4.
Figure 6:
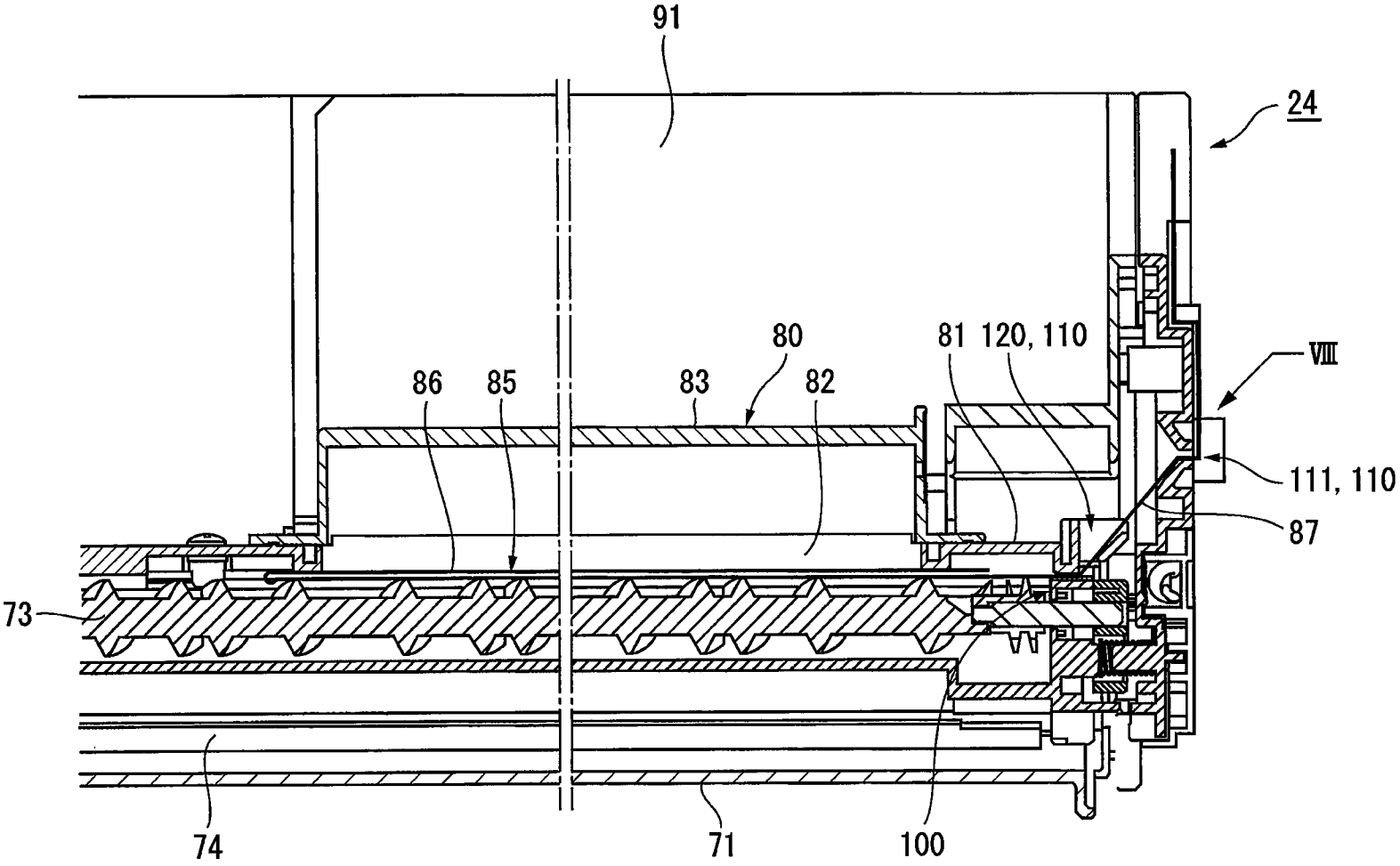
FIG. 6 is a sectional view taken along line VI-VI of FIG. 5.
Figure 7:
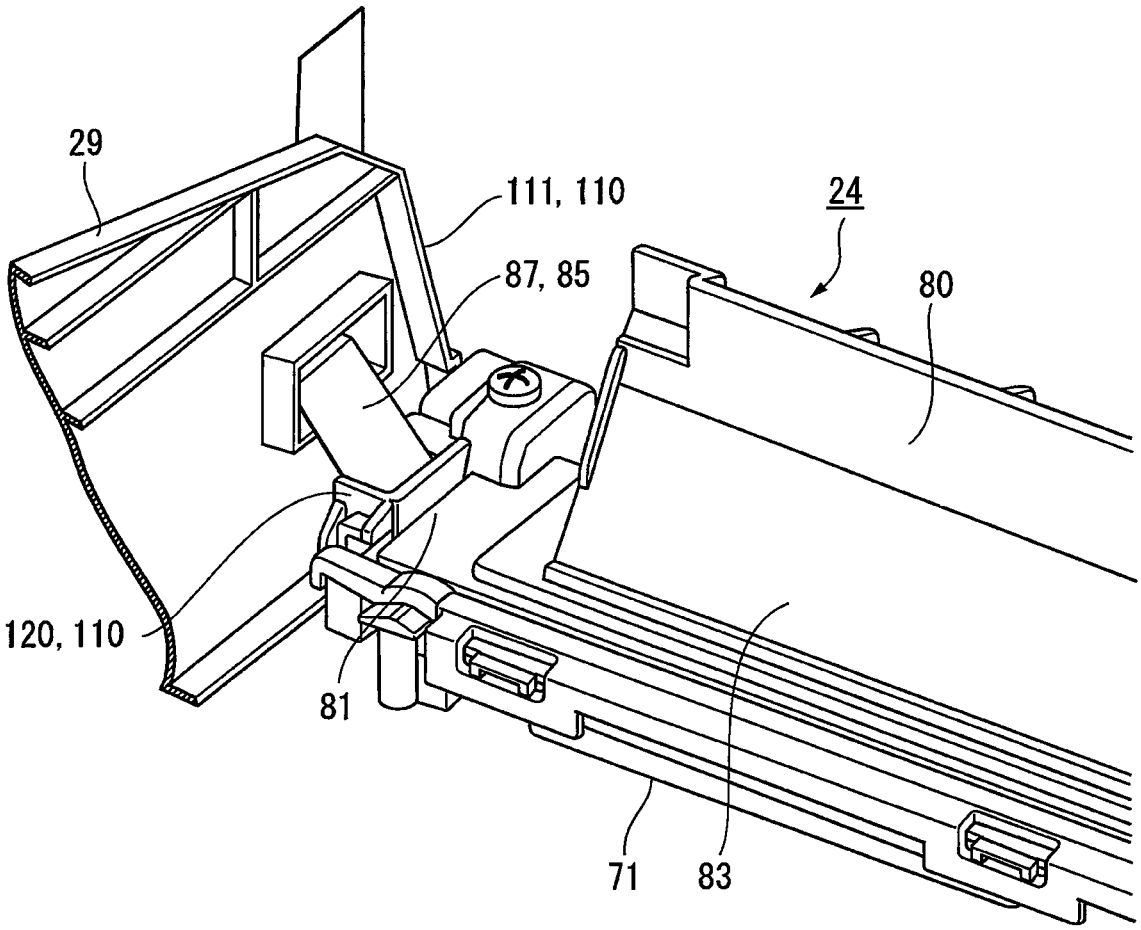
FIG. 7 is a perspective view when viewed in the direction of arrow VII in FIG. 5.

Note that, in the present exemplary embodiment, the process cartridge 26 includes side cartridge coverings 29 serving as side members that cover the both sides of the first and second cartridge housings 27*a* and 28*a* as illustrated in FIG. 4 and FIG. 5.

—Basic Configuration of Developing Device—

In the present exemplary embodiment, as illustrated in FIG. 2 and FIG. 3, the developing device 24 includes a developer container 71 serving as a developer containing unit that contains a developer, and the developer container 71 has a development opening 71*a* that is formed at a position facing the photoconductor 21 so as to extend in the axial direction of the photoconductor 21. A developing roller 72 serving as a developer holding unit is disposed at a position facing the development opening 71*a*, and in the present exemplary embodiment, the developing roller 72 includes a fixed magnet roller having a plurality of magnetic poles, which are arranged so as to have a predetermined positional relationship, and a developing sleeve that is capable of rotating about the fixed magnet roller. In the developer container 71, a pair of stirring transport members 73 and 74 each serving as a stirring transport unit that stirs and transports the developer are arranged in an oblique direction with respect to the vertical direction on the rear surface side of the developing roller 72, and in the present exemplary embodiment, each of the stirring transport members 73 and 74 includes a rotary shaft and a blade member that is disposed on the rotary shaft in a helical manner. In addition, a layer-thickness control member 75 that controls the layer thickness of the developer on the developing roller 72 is disposed so as to face a portion of the developing roller 72 that is located further upstream than the development opening 71*a* in the transport direction of the developer, and in the present exemplary embodiment, a layer-thickness control roller is used as the layer-thickness control member 75. Note that reference signs 76 and 77 denote seal members that are provided at an edge of the development opening 71*a* of the developer container 71 and that closes the space between the developer container 71 and the photoconductor 21.

—Developer Storage Device—

In the present exemplary embodiment, in the developing device 24, a developer storage device 80 serving as a developer storing unit that stores the starter developer to be used at the beginning of use of the developing device 24 is mounted on the top of the developer container 71 as illustrated in FIG. 2 to FIG. 6.

Figure 9:
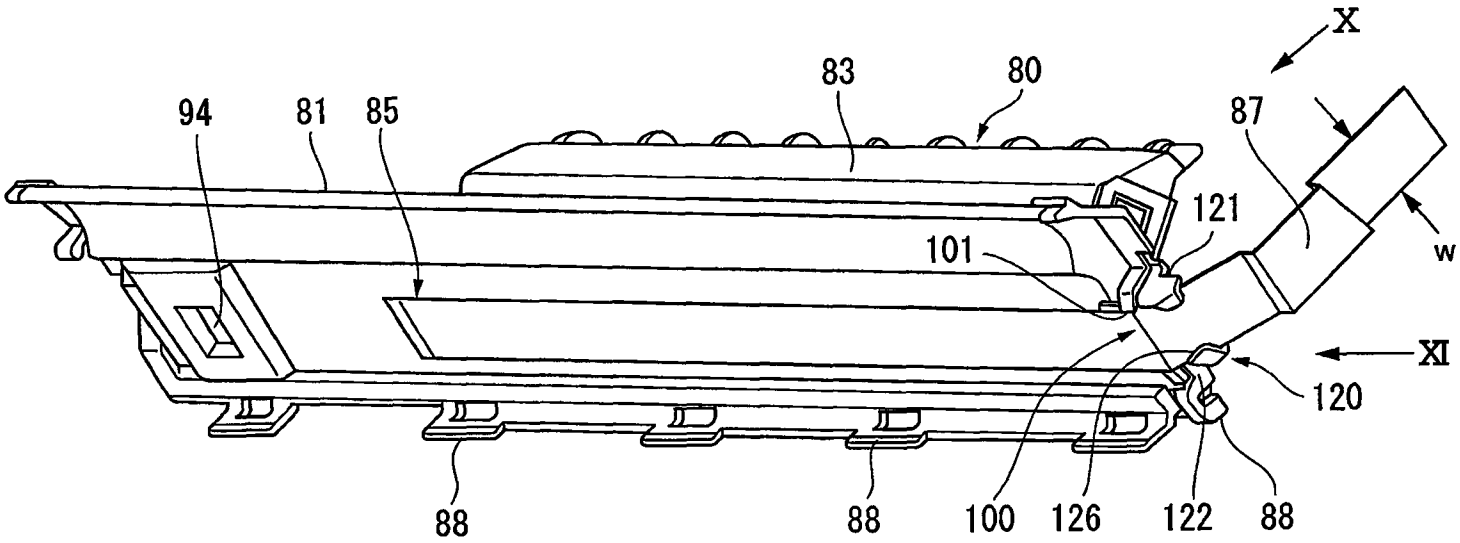
FIG. 9 is a perspective view of a developer storing unit that is used in the exemplary embodiment.
Figure 10:
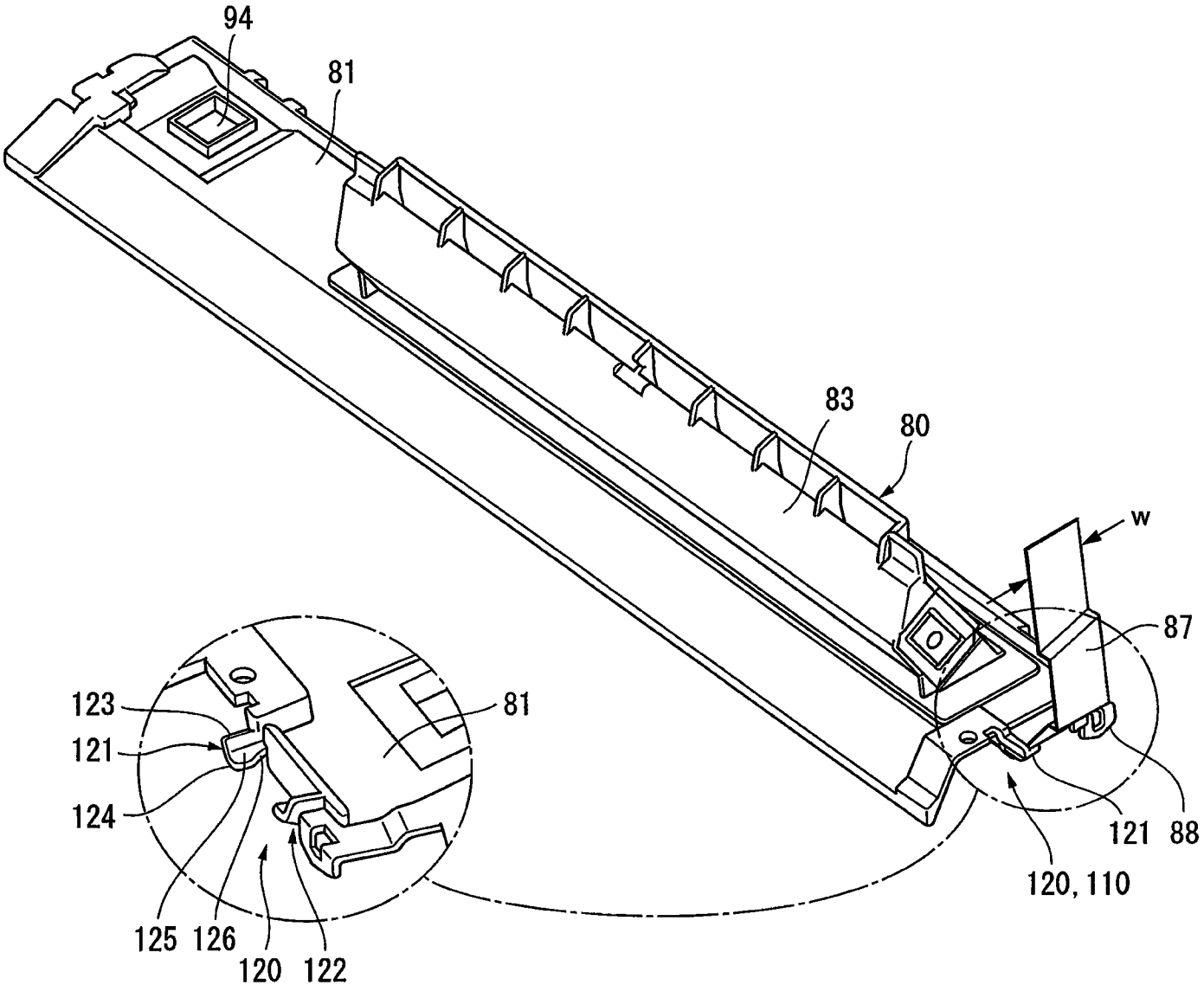
FIG. 10 is a perspective view when viewed in the direction of arrow X in FIG. 9.
Figure 11:
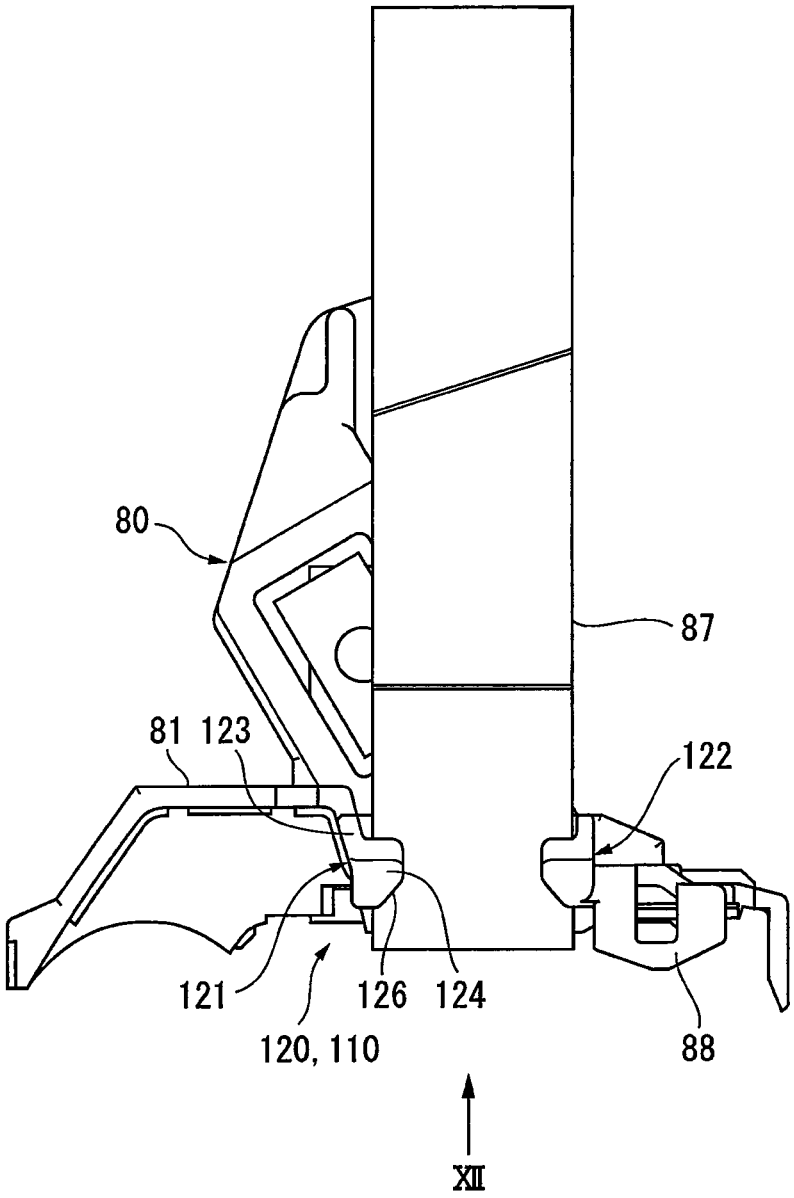
FIG. 11 is a view as seen in the direction of arrow XI of FIG. 9.
Figure 12:
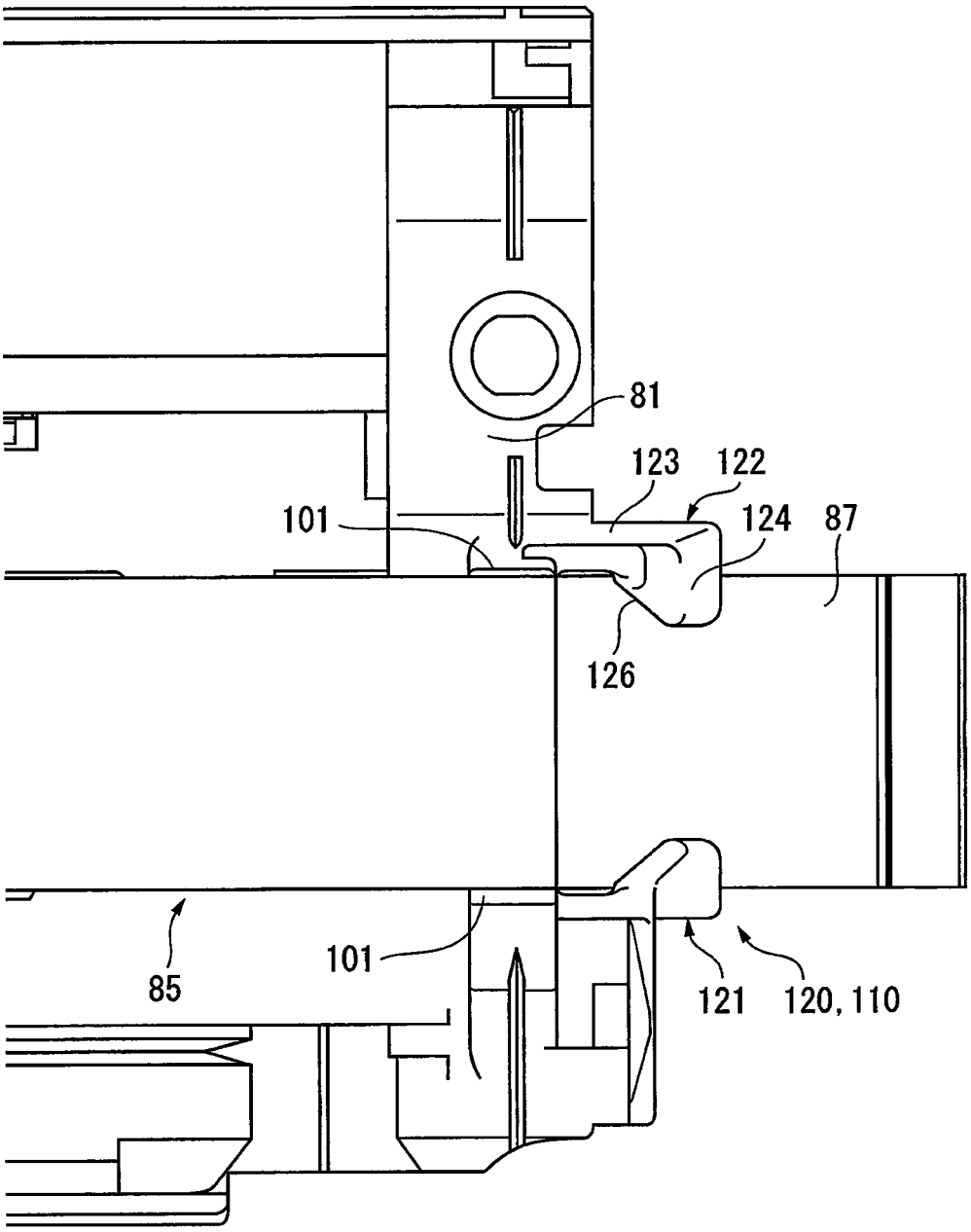
FIG. 12 is a view as seen in the direction of arrow XII of FIG. 11.

In the present exemplary embodiment, as illustrated in FIG. 3, FIG. 9, and FIG. 10, a top frame member 81 forming the top of the developer container 71 is provided in such a manner as to be detachable from the developer container 71, and a slit-shaped connection opening 82 extending along the axial direction of the stirring transport member 73 is formed in the top frame member 81.

In the present exemplary embodiment, the developer storage device 80 includes a storage container 83 that is connected thereto by being inserted into the connection opening 82 of the top frame member 81, and the storage container 83 is formed to have a length shorter than that of the developer container 71.

The starter developer is stored in the storage container 83, and the connection opening 82 of the top frame member 81 is closed by a seal tape 85 that serves as a sealing unit.

Note that an appropriate number of attachment hooks 88 that elastically deform so as to be capable of being hooked onto an edge of a top opening (not illustrated) of the developer container 71 are formed at the peripheral edge of the top frame member 81 of the developer container 71, and the top frame member 81 is placed into the top opening of the developer container 71.

In the present exemplary embodiment, the seal tape 85 includes a sealing tape portion 86 that seals the connection opening 82 of the top frame member 81 and that is capable of being peeled off along the connection opening 82 of the top frame member 81 and an extended tape portion 87 that is folded at an end of the sealing tape portion 86 in the longitudinal direction and that extends along the sealing tape portion 86 in such a manner as to project outward beyond the sealing tape portion 86.

Here, the sealing tape portion 86 of the seal tape 85 needs to be formed of a tape member that is capable of being fixed onto the edge of the connection opening 82 of the top frame member 81 by heat sealing or by using an adhesive and that is capable of being peeled off from the edge of the connection opening 82. Thus, in the present exemplary embodiment, a material that satisfies the above demand is selected as the material of the seal tape 85. Note that it is obvious that the sealing tape portion 86 and the extended tape portion 87 may be made of different materials as the seal tape 85.

In the present exemplary embodiment, an end portion of the extended tape portion 87 of the seal tape 85 is positioned in such a manner as to project outward from an end of the top frame member 81 in the longitudinal direction in a state where the connection opening 82 of the top frame member 81 is sealed by the sealing tape portion 86 of the seal tape 85.

—Developer Replenishment Device—

In the present exemplary embodiment, as illustrated in FIG. 2 to FIG. 5, a developer replenishment device 90 is mounted on the developing device 24 so as to be located at a position adjacent to a portion of the developer container 71, the portion being located on the side opposite to the side on which the photoconductor 21 is disposed. In the present exemplary embodiment, the developer replenishment device 90 includes a container receiving portion 91 that is provided at a position adjacent to the top frame member 81 of the developer container 71 and that is capable of accommodating a replenishment container 92 in which a replenishing developer (which may include only a toner or may include a toner and a carrier) is stored beforehand. A certain-quantity replenishment unit 93 that is capable of supplying a certain quantity of the replenishing developer by causing a transport member disposed in the replenishment container 92 to rotate is disposed at a position facing an end portion of the replenishment container 92, which is accommodated in the container receiving portion 91, and as illustrated in FIG. 9 and FIG. 10, the developer container 71 is replenished with a certain quantity of the replenishing developer by the certain-quantity replenishment unit 93 through a replenishment port 94 that is formed in a predetermined portion of the top frame member 81 of the developer container 71.

—Scraping Mechanism—

Figure 8:
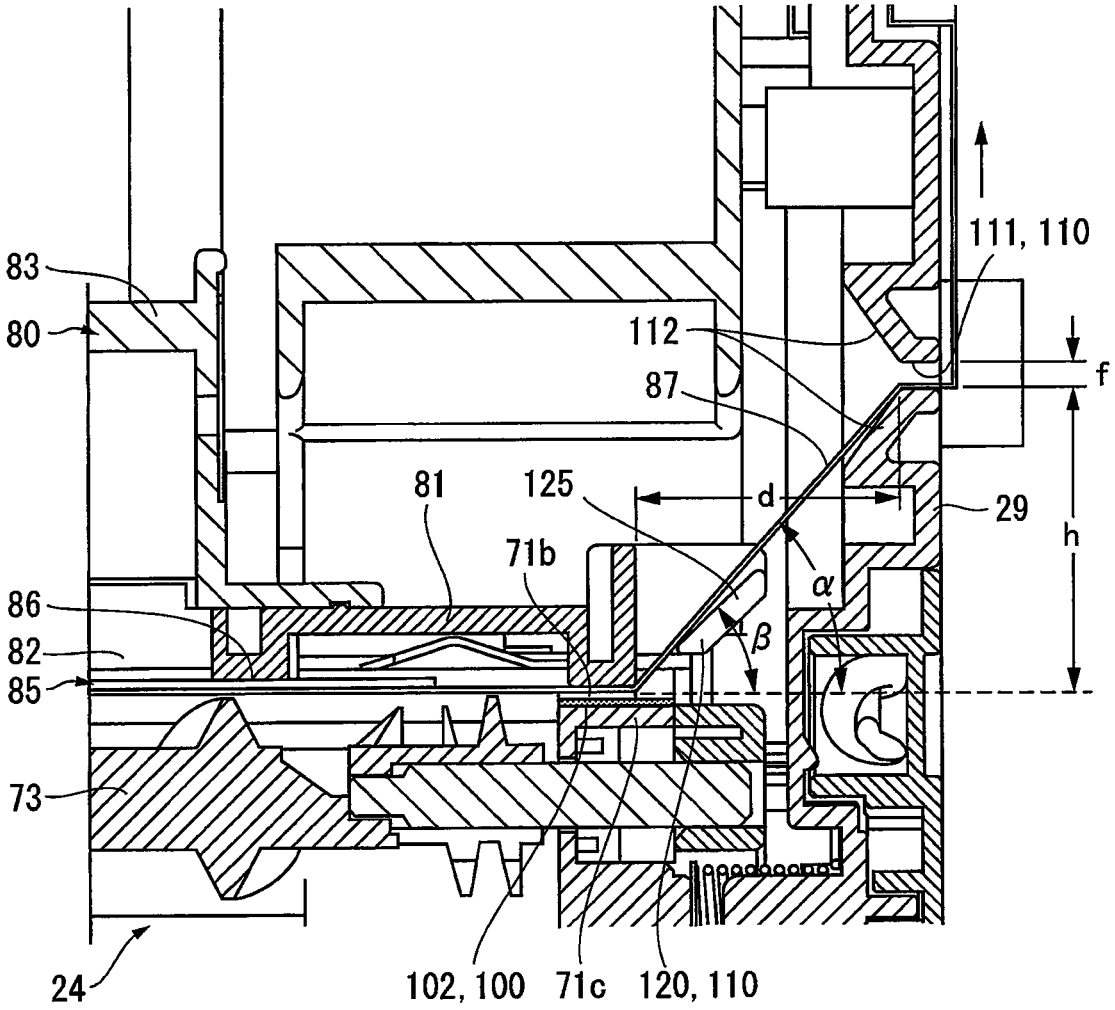
FIG. 8 is an enlarged view of a portion VIII in FIG. 6.

In the present exemplary embodiment, as illustrated in FIG. 8, a slit-shaped draw-out port 71*b* from which the extended tape portion 87 of the seal tape 85 is to be pulled out is formed in an end portion of the developer container 71 in the longitudinal direction. In addition, in the present exemplary embodiment, a scraping mechanism 100 that scrapes off developer powder deposited on the seal tape 85 is provided at a position facing the draw-out port 71*b* of the developer container 71.

Here, as illustrated in FIG. 8 and FIG. 9, the scraping mechanism 100 includes a control wall 101 that is formed at an end of the top frame member 81 in the longitudinal direction in such a manner as to have a step slightly larger than the thickness of the seal tape 85 and that controls the position of the seal tape 85 in a width direction crossing the direction in which the extended tape portion 87 is to be pulled out, and the draw-out port 71*b* is ensured in a region of the top frame member 81 surrounded by the control wall 101. On the other hand, an elastic pad 102 that is formed of an elastic member having a surface whose frictional resistance is reasonably large is fixed to a portion of an upper edge of a side wall 71*c* that is located at an end of the developer container 71 in the longitudinal direction, the portion corresponding to the draw-out port 71*b*. In a state where the elastic pad 102 is elastically in contact with the extended tape portion 87 of the seal tape 85 and with the sealing tape portion 86 of the seal tape 85, which follows movement of the extended tape portion 87, the seal tape 85 is movably pressed against the elastic pad 102. Thus, in the present exemplary embodiment, the scraping mechanism 100 causes the seal tape 85 to move while the position of the seal tape 85 in the width direction is controlled by the control wall 101 and causes the elastic pad 102 to scrape off developer powder deposited on a surface of the seal tape 85, the surface being in contact with the elastic pad 102.

—Tape Holding Mechanism—

In the present exemplary embodiment, the extended tape portion 87 of the seal tape 85 that projects outward from the end of the developer container 71 in the longitudinal direction is held by a tape holding mechanism 110 that serves as a holding unit.

<Pull-Out Port>

In the present exemplary embodiment, the tape holding mechanism 110 is disposed outside the developer storage device 80 in the longitudinal direction with a space formed therebetween. An end portion of the extended tape portion 87 of the seal tape 85 is held by a pull-out port 111 that is formed in the side cartridge coverings 29, and the extended tape portion 87 of the seal tape 85 projecting outward is pulled out from the pull-out port 111 when the process cartridge 26 is used (corresponding to when the developing device 24 is used).

Here, the pull-out port 111 has a slit-shaped opening that allows the extended tape portion 87 of the seal tape 85 and the sealing tape portion 86 of the seal tape 85, which follows movement of the extended tape portion 87, to pass therethrough, and a dimension w of the pull-out port 111 in the width direction is selected by taking into consideration a dimensional tolerance for a width dimension w of the seal tape 85 and a positional tolerance for the position where the seal tape 85 seals the connection opening 82. As a dimension f of the pull-out port 111 in the height direction of the pull-out port 111, a value (e.g., a value that is about 5 to about 10 times larger than the thickness of the seal tape 85), which is sufficiently large with respect to the thickness dimension of the seal tape 85, is selected, and thus, the seal tape 85 is pulled out in a state where the position of the seal tape 85 in the width direction is controlled by the pull-out port 111.

In particular, in the present exemplary embodiment, as illustrated in FIG. 8, the pull-out port ill is formed at a position that is spaced apart from the position of the scraping mechanism 100 of the developer container 71 (corresponding to the position of the draw-out port 71*b*) by a dimension d in the horizontal direction and that is higher than the position of the scraping mechanism 100 by a dimension h. In this case, the dimensions d and h may be suitably selected, and in the present exemplary embodiment, the dimensions d and h are selected in such a manner that a portion of the seal tape 85 extending from the draw-out port 71*b* to the pull-out port 111 is in an inclined position at an angle α with respect to the horizontal line. Although the angle α of the inclined position of the portion of the seal tape 85 may be suitably selected, the angle α may be set within the range of about 45 degrees to about 60 degrees from the standpoint of ensuring that the dimension h in the vertical direction is reasonably large while the length of the dimension d is limited in terms of design.

In addition, in the present exemplary embodiment, a guide tapered portion 112 that is widened toward the developer container 71 is formed on the start of the pull-out port 111 of the side cartridge coverings 29, and the guide tapered portion 112 includes a portion extending obliquely upward and a portion extending obliquely downward. In this case, the portion of the guide tapered portion 112 that extends obliquely downward is inclined at an angle larger than the angle α with respect to the horizontal line, and thus, there is no concern that the seal tape 85 will strongly come into contact with the guide tapered portion 112 when the seal tape 85 is pulled out from the pull-out port 111.

<Temporary Holding Portion>

In the present exemplary embodiment, as illustrated in FIG. 7 to FIG. 10, the tape holding mechanism 110 further includes a temporary holding portion 120. When the developer storage device 80 serving as a subassembly is mounted onto the developer container 71 of the developing device 24, the temporary holding portion 120 temporarily holds the extended tape portion 87 of the seal tape 85, which projects outward from an end portion of the developer storage device 80 in the longitudinal direction at a position that is spaced apart from the position of the scraping mechanism 100 and that is located further inside than the side cartridge coverings 29 are.

In the present exemplary embodiment, the temporary holding portion 120 includes a pair of surrounding arms 121 and 122, so that the temporary holding portion 120 is capable of holding the extended tape portion 87 of the seal tape 85 such that the extended tape portion 87 is in the temporarily-held position, in which the extended tape portion 87 is inclined upward from the position of the scraping mechanism 100. The pair of surrounding arms 121 and 122 are each substantially L-shaped when viewed in cross section and surround and hold the side edges of the extended tape portion 87 in the width direction. Here, the pair of surrounding arms 121 and 122 include a pair of supporting pieces 123 that project outward from an end portion of the top frame member 81, which is a portion of the developer storage device 80, in the longitudinal direction, and arm pieces 124 that project toward each other in a region between the pair of supporting pieces 123, each of the supporting pieces 123 and a corresponding one of the arm pieces 124 being integrally formed with each other. A value that is approximately equal to the width dimension w of the seal tape 85 is selected as the dimension between the supporting pieces 123 of the surrounding arms 121 and 122, and a value that is shorter than the width dimension w of the seal tape 85 is selected as the dimension between the arm pieces 124.

In addition, in the present exemplary embodiment, the arm pieces 124 of the surrounding arms 121 and 122 each have a holding surface 125 that is formed so as to be inclined in an upward direction toward the side cartridge coverings 29 and on which the seal tape 85 is to be temporarily held. In the present exemplary embodiment, as illustrated in FIG. 8, an angle β formed by each of the holding surfaces 125 and the horizontal line is selected so as to be smaller than the angle α of the inclined position of the seal tape 85, which extends from the position of the scraping mechanism 100 to the pull-out port 111 of the side cartridge coverings 29, and a movement path of the seal tape 85 is formed at a position where the seal tape 85 does not come into contact with the holding surfaces 125 of the temporary holding portion 120.

Furthermore, in the present exemplary embodiment, an inclined portion 126 that is widened toward the scraping mechanism 100 in the width direction of the seal tape 85 is formed in a portion of each of the arm pieces 124 of the surrounding arms 121 and 122, the portion of each of the arm pieces 124 being located on the side on which the scraping mechanism 100 is disposed.

—Assembly of Process Cartridge—

Assembly of the process cartridge according to the present exemplary embodiment will now be described.

In the present exemplary embodiment, when the process cartridge 26 is assembled, it is necessary to prepare the photoconductor unit 27 and the developing unit 28 and connect these units 27 and 28 to each other. In addition, it is necessary to cover the both sides of these units 27 and 28 with the side cartridge coverings 29.

In this case, regarding the developing unit 28, the developing device 24 is mounted onto the second cartridge housing 28*a*, and it is necessary to mount the developer storage device 80, which serves as a subassembly, and the developer replenishment device 90 onto the developing device 24.

In this case, regarding the developer storage device 80, as illustrated in FIG. 9 and FIG. 10, the storage container 83 is inserted in the connection opening 82 of the top frame member 81 of the developer container 71 and is connected to the developer storage device 80, and the connection opening 82 is sealed by the seal tape 85 in such a manner that the seal tape 85 is capable of being peeled off from the connection opening 82. In this case, the extended tape portion 87 of the seal tape 85 is in a state of being folded at the end of the sealing tape portion 86 in the longitudinal direction and projecting outward from the end of the top frame member 81 in the longitudinal direction.

The developer storage device 80 having such a configuration is placed as a subassembly into the top opening of the developer container 71, and in the present exemplary embodiment, as illustrated in FIG. 9 to FIG. 12, since a projecting portion of the extended tape portion 87 of the seal tape 85, which projects outward from the end of the top frame member 81, is temporarily held by the temporary holding portion 120 (tape holding mechanism 110), which is provided at the end of the top frame member 81 in the longitudinal direction, the projecting portion of the extended tape portion 87 of the seal tape 85 is maintained in the temporarily-held position in which the projecting portion is latched to the temporary holding portion 120.

Thus, when the developer storage device 80 is placed into the top opening of the developer container 71, displacement of the position of the projecting portion of the extended tape portion 87 of the seal tape 85 is suppressed. Therefore, it is not necessary for an operator to perform an operation of holding the extended tape portion 87 of the seal tape 85.

In particular, in the present exemplary embodiment, since the temporary holding portion 120 causes the extended tape portion 87 of the seal tape 85 to be held on the holding surfaces 125 of the pair of surrounding arms 121 and 122 that are located above the position of the scraping mechanism 100, the holding surfaces 125 each extending obliquely upward, while being surrounded by the surrounding arms 121 and 122, the extended tape portion 87 of the seal tape 85 is inclined so as to extend obliquely upward from the position of the scraping mechanism 100 and then held by the surrounding arms 121 and 122, and a portion of the extended tape portion 87 of the seal tape 85 that has passed through the surrounding arms 121 and 122 drops downward under its own weight. Accordingly, the extended tape portion 87 of the seal tape 85 is maintained in the temporarily-held position in which the extended tape portion 87 forms a mountain-like shape, and while the sealing tape portion 86 of the seal tape 85 seals the connection opening 82, the extended tape portion 87 is folded along the sealing tape portion 86 and then held by the temporary holding portion 120 so as to be maintained in the temporarily-held position.

In addition, in the present exemplary embodiment, as illustrated in FIG. 9 to FIG. 12, each of the surrounding arms 121 and 122 of the temporary holding portion 120 includes the inclined portion 126, which is located on the side on which the scraping mechanism 100 is disposed and which is widened toward the scraping mechanism 100 in the width direction of the seal tape 85, and thus, the extended tape portion 87 of the seal tape 85 may be further easily set by guiding operation of the inclined portions 126 when the extended tape portion 87 of the seal tape 85 is hooked onto the surrounding arms 121 and 122.

When the side cartridge coverings 29 are mounted in the assembly of the process cartridge 26, the extended tape portion 87 of the seal tape 85, which has been temporarily held by the temporary holding portion 120, may be drawn out from the pull-out port 111 formed in one of the side cartridge coverings 29.

In this state, as illustrated in FIG. 8, the extended tape portion 87 of the seal tape 85 is positioned so as to be inclined upward from the position of the scraping mechanism 100 toward the pull-out port 111.

—When Process Cartridge is Used—

Next, when the process cartridge 26 is used, after the process cartridge 26 has been set into a predetermined cartridge receiving portion of the housing of the image forming apparatus, which is not illustrated, it is necessary to release the sealed state of the developing device 24, which has been maintained by the seal tape 85, in order to enable the developing device 24, and it is necessary to supply the starter developer, which has been stored in the developer storage device 80, into the developer container 71.

In this case, as illustrated in FIG. 8, an operator may hold an end portion of the extended tape portion 87 of the seal tape 85 projecting outward from one of the side cartridge coverings 29 of the process cartridge 26 and may pull out the extended tape portion 87 in, for example, an upward direction.

In this case, the extended tape portion 87 of the seal tape 85 is pulled in such a manner as to sequentially move toward the pull-out port 111 through the position of the scraping mechanism 100, and the sealing tape portion 86 moves by following the movement of the extended tape portion 87 and is peeled off from the edge of the connection opening 82. In this state, although a side of the sealing tape portion 86 that has been in contact with the starter developer in the storage container 83 is exposed to the outside, developer powder deposited on the sealing tape portion 86 is scraped off by the elastic pad 102 when the sealing tape portion 86 passes through the scraping mechanism 100, and thus, there is no concern that the sealing tape portion 86 of the seal tape 85 will be pulled out while the developer powder remains on the sealing tape portion 86.

In the present exemplary embodiment, since the position of the seal tape 85 in the width direction is controlled by the control wall 101 of the scraping mechanism 100, when the operation of pulling out the seal tape 85 is performed, the extended tape portion 87 and the sealing tape portion 86 of the seal tape 85 inevitably pass through the elastic pad 102, and there is no concern that the seal tape 85 will be pulled out without passing through the elastic pad 102.

In addition, in the present exemplary embodiment, if the end portion of the extended tape portion 87 of the seal tape 85 is pulled out in such a manner as to be inclined in the width direction, the position of the seal tape 85 extending from the scraping mechanism 100 to the pull-out port 111 will be controlled by the control wall 101 of the scraping mechanism 100 and the pull-out port 111. Thus, there is only a small concern that wrinkles will be generated in the seal tape 85 passing through the scraping mechanism 100, and leakage of the developer and a breakage phenomenon of the seal tape 85 due to such wrinkles of the seal tape 85 are suppressed.

In addition, in the present exemplary embodiment, when the seal tape 85 is pulled out from the process cartridge 26, if the end portion of the extended tape portion 87 is pulled upward, as illustrated in FIG. 8, the seal tape 85 comes into contact with the pull-out port 111 at two points, which are the start edge and the exit edge of the pull-out port 111, when passing through the pull-out port 111. Regarding this, for example, if the end portion of the extended tape portion 87 of the seal tape 85 is pulled downward, the seal tape 85 will come into contact with the entire bottom surface of the pull-out port 111 when passing through the pull-out port ill, and thus, there is a concern that the frictional resistance generated when the seal tape 85 is pulled out will be large.

In addition, since the seal tape 85 extending from the position of the scraping mechanism 100 to the pull-out port 111 while being in the inclined position does not come into contact with the temporary holding portion 120, there is no concern that the seal tape 85 will break as a result of coming into contact with the temporary holding portion 120 or will break due to frictional resistance when the seal tape 85 is pulled out.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a developer storing unit that stores a developer before use of the developing device;

a developer containing unit that contains, when the developing device is used, the developer stored in the developer storing unit such that the developer is capable of being stirred by the developer containing unit;

a developer holding unit that is provided in a portion of the developer containing unit and that holds the developer contained in the developer containing unit and moves the developer in a rotation direction;

a sealing unit including a sealing tape portion that seals a slit-shaped opening formed in the developer storing unit along a longitudinal direction of the developer storing unit while the sealing tape portion is capable of being pulled out and that seals the slit-shaped opening of the developer storing unit by being removably fixed onto an edge of the opening and an extended tape portion that is folded at an end of the sealing tape portion in a longitudinal direction of the sealing tape portion and that extends along the sealing tape portion in such a manner as to project outward beyond the sealing tape portion;

a scraping unit that is disposed at an end portion of the developer storing unit in the longitudinal direction of the developer storing unit and that causes the extended tape portion of the sealing unit to move while making frictional contact with the scraping unit so as to scrape off developer powder deposited on the extended tape portion and on the sealing tape portion, which follows movement of the extended tape portion; and a holding unit that is disposed outside the scraping unit in the longitudinal direction of the developer storing unit with a space formed between the holding unit and the scraping unit and that holds the extended tape portion and the sealing tape portion such that the extended tape portion and the sealing tape portion are capable of moving, wherein the scraping unit and the holding unit are located at one end side of the developer storing unit in the longitudinal direction of the developer storing unit, wherein the holding unit has a pull-out port that is formed in a side member disposed outside the developer storing unit in the longitudinal direction of the developer storing unit and that holds the extended tape portion of the sealing unit such that the extended tape portion is capable of being pulled out and passed through the pull-out port, wherein the holding unit and the developer storing unit have a fixed positional relationship therebetween.

2. The developing device according to claim 1, wherein the holding unit includes a temporary holding portion that is disposed at an end portion of the developer storing unit in the longitudinal direction of the developer storing unit and that is capable of holding the extended tape portion of the sealing unit such that the extended tape portion is in a temporarily-held position in which the extended tape portion is inclined upward from a position of the scraping unit.

3. The developing device according to claim 1, wherein the holding unit includes a temporary holding portion that is disposed at an end portion of the developer storing unit in the longitudinal direction of the developer storing unit in such a manner as to be located between the pull-out port and the scraping unit and that is capable of holding the extended tape portion of the sealing unit in a temporarily-held position in which the extended tape portion is inclined upward from a position of the scraping unit.

4. The developing device according to claim 1, wherein the pull-out port serving as the holding unit is positioned above the scraping unit.

5. The developing device according to claim 3, wherein the pull-out port serving as the holding unit is positioned above the scraping unit.

6. The developing device according to claim 2, wherein the temporary holding portion serving as the holding unit includes a pair of surrounding anus that surround and hold side edges of the extended tape portion of the sealing unit in a width direction of the sealing unit.

7. The developing device according to claim 3, wherein the temporary holding portion serving as the holding unit includes a pair of surrounding arms that surround and hold side edges of the extended tape portion of the sealing unit in a width direction of the sealing unit.

8. The developing device according to claim 6, wherein the surrounding arms, which are included in the temporary holding portion serving as the holding unit, each include an inclined portion that is located on a side on which the scraping unit is disposed and that is widened toward the scraping unit in the width direction of the sealing unit.

9. The developing device according to claim 7, wherein the surrounding arms, which are included in the temporary holding portion serving as the holding unit, each include an inclined portion that is located on a side on which the scraping unit is disposed and that is widened toward the scraping unit in the width direction of the sealing unit.

10. The developing device according to claim 3, wherein the pull-out port is positioned above the scraping unit, and wherein the temporary holding portion has a holding surface that is inclined upward and on which the sealing unit is to be temporarily held.

11. The developing device according to claim 3, wherein a movement path of the sealing unit that is located between the scraping unit and the pull-out port is formed at a position at which the sealing unit does not come into contact with the temporary holding portion.

12. A process cartridge that is detachably mounted on a housing of an image forming apparatus, the process cartridge comprising:

an image holding unit on which a developable latent image is held; and the developing device according to claim 1 that is disposed so as to face the image holding unit and that develops a latent image on the image holding unit.

13. An image forming apparatus comprising:

an image holding unit on which a developable latent image is held; and the developing device according to claim 1 that is disposed so as to face the image holding unit and that develops a latent image on the image holding unit.

* * * * *